US007623014B2

(12) United States Patent
Hsieh et al.

(10) Patent No.: US 7,623,014 B2
(45) Date of Patent: Nov. 24, 2009

(54) CHOKE COIL

(75) Inventors: Roger Hsieh, Hsin-chu (TW); Yi-Min Huang, Hsin-chu (TW); Lan-Chin Hsieh, Hsin-chu (TW); Yung-Chien Wang, Hsin-chu (TW)

(73) Assignee: Cyntec Co., Ltd., Hsin-chu (TW)

( * ) Notice: Subject to any disclaimer, the term of this patent is extended or adjusted under 35 U.S.C. 154(b) by 0 days.

(21) Appl. No.: 12/127,223

(22) Filed: May 27, 2008

(65) Prior Publication Data

US 2009/0212894 A1 Aug. 27, 2009

(30) Foreign Application Priority Data

Feb. 22, 2008 (TW) ..... 97106258 A

(51) Int. Cl.

| | |
|---|---|
| ***H01F 27/30*** | (2006.01) |
| ***H01F 27/02*** | (2006.01) |
| ***H01F 38/30*** | (2006.01) |
| ***H01F 27/29*** | (2006.01) |

(52) U.S. Cl. ..... 336/83; 336/185; 336/96; 336/84 M; 336/192

(58) Field of Classification Search ..... None
See application file for complete search history.

(56) References Cited

U.S. PATENT DOCUMENTS

| | | | | |
|---|---|---|---|---|
| 2,391,563 | A | 12/1945 | Goldberg | |
| 2,966,704 | A | 1/1961 | O'Brian et al. | |
| 3,949,032 | A | 4/1976 | Hossenlopp | 264/61 |
| 4,769,900 | A * | 9/1988 | Morinaga et al. | 29/606 |
| 5,010,313 | A * | 4/1991 | Kaneko et al. | 335/296 |
| 6,137,390 | A | 10/2000 | Tung et al. | 336/83 |
| 6,198,373 | B1 * | 3/2001 | Ogawa et al. | 336/83 |
| 6,204,744 | B1 | 3/2001 | Shafer et al. | 336/83 |
| 6,535,095 | B2 * | 3/2003 | Aoki et al. | 336/83 |
| 6,565,505 | B2 * | 5/2003 | Ishibiki | 600/133 |
| 6,727,792 | B2 * | 4/2004 | Amada et al. | 336/192 |
| 7,183,886 | B2 * | 2/2007 | Ooki | 336/83 |
| 7,215,232 | B2 * | 5/2007 | Aoki et al. | 336/83 |
| 7,358,843 | B2 * | 4/2008 | Takayama et al. | 336/200 |
| 2003/0179062 | A1 * | 9/2003 | Kuwata et al. | 336/83 |
| 2008/0055034 | A1 * | 3/2008 | Tsunemi et al. | 336/83 |

FOREIGN PATENT DOCUMENTS

| | | |
|---|---|---|
| WO | WO 92/05568 | 4/1992 |

* cited by examiner

*Primary Examiner*—Elvin G Enad
*Assistant Examiner*—Mangtin Lian
(74) *Attorney, Agent, or Firm*—Mendelsohn, Drucker & Associates, PC; Steve Mendelsohn

(57) ABSTRACT

In one embodiment, a choke coil has a magnetic core, a coil, and magnetic material. The core has a first permeability which is from about 350 to 1200. The coil is wrapped around the core. The magnetic material surrounds the coil and has a second permeability. The first permeability is higher than the second permeability. The second permeability is from about 5 to 30.

23 Claims, 11 Drawing Sheets

CHOKE COIL

BACKGROUND OF THE INVENTION

1. Field of the Invention

The present invention generally relates to a passive component, and more particularly to a choke coil.

2. Description of the Prior Art

Referring to FIG. 1A and FIG. 1B, conventional choke coil 100 includes a drum core 110, a coil 120, and a shell 130. The drum core 110 includes a middle core 112, an upper core 111, and a lower core 113. The upper core 111 and the lower core 113 are connected to opposing ends of the middle core 112. The coil 120 is wrapped around the drum core 110. The shell 130 surrounds the coil 120 and the drum core 110. Moreover, there is an air space t between the coil 120 and the shell 130. There is also an air space t between the drum core 110 and the shell 130.

When the drum core 110 is disposed in the center of the conventional choke coil 100, the inductance of the conventional choke coil 100 is about 4.45 uH. When the drum core 110 is shifted and touches the shell 130 as shown in FIG. 1C, the inductance of the conventional choke coil 100 is about 6.44 uH. As the position of the drum core 110 changes, the air space t changes, and, as a result, the inductance of the conventional choke coil 100 also changes.

Therefore, during the manufacturing process of the conventional choke coil 100, the drum core 110 should be precisely positioned so as to fix the air space t to ensure that the conventional choke coil 100 has a constant inductance for different instances of the conventional choke coil 100. However, the process of precisely positioning the drum core 110 increases the cost of manufacturing the conventional choke coil 100. Moreover, the air space t decreases the magnetic flux passing through the drum core 110 and the shell 130, and, as a result, decreases the inductance of the conventional choke coil 100. The inductance of the conventional choke coil 100 is able to be adjusted by changing the number of turns of the coil 120 and the dimension of the drum core 110.

Another conventional choke coil (compression molding type) is shown in U.S. Pat. No. 6,204,744. A coil and a powder magnetic material are placed within a mold cavity of a pressure molding machine, and then the choke coil is formed by applying a high pressure. Because the coil is not sufficiently supported within the pressure molding machine, the insulating coating of the coil may be removed due to the pressure of the forming process. As a result, the choke coil may have the problem that the coil is shorted.

SUMMARY OF THE INVENTION

In one embodiment, the present invention provides a choke coil which has better saturation properties and a higher applicable current by selecting a proper permeability range of the core and the magnetic material.

In this embodiment, the present invention provides a choke coil without having to position the core precisely, thereby simplifying the manufacturing process of the choke coil.

In this embodiment, the present invention provides a choke coil where the coil is sufficiently supported during application of the magnetic material so as to avoid the problem that the coil may be shorted.

In this embodiment, the present invention provides a choke coil without applying a high pressure to the coil during the manufacturing process so as to improve the stability of the manufacturing process and the reliability of the choke coil.

In this embodiment, the present invention provides a choke coil having an increased number of parameters available for adjusting the inductance of the choke coil.

In order to achieve the above features, this embodiment of the present invention provides a choke coil including a magnetic core, a coil, and magnetic material. The magnetic core has a first permeability which is from about 350 to about 1200. The coil is wrapped around the core. The magnetic material surrounds the coil and has a second permeability. The first permeability is higher than the second permeability. The second permeability is from about 5 to about 30.

Other objectives, features and advantages of the present invention will be further understood from the further technology features disclosed by the embodiments of the present invention wherein there are shown and described preferred embodiments of this invention, simply by way of illustration of modes best suited to carry out the invention.

DETAILED DESCRIPTION OF THE INVENTION

The detailed description of the present invention will be discussed in the following embodiments, which are not intended to limit the scope of the present invention, but can be adapted for other applications. While drawings are illustrated in details, it is appreciated that the quantity of the disclosed components may be greater or less than that disclosed, except expressly restricting the amount of the components.

Figure 2A:
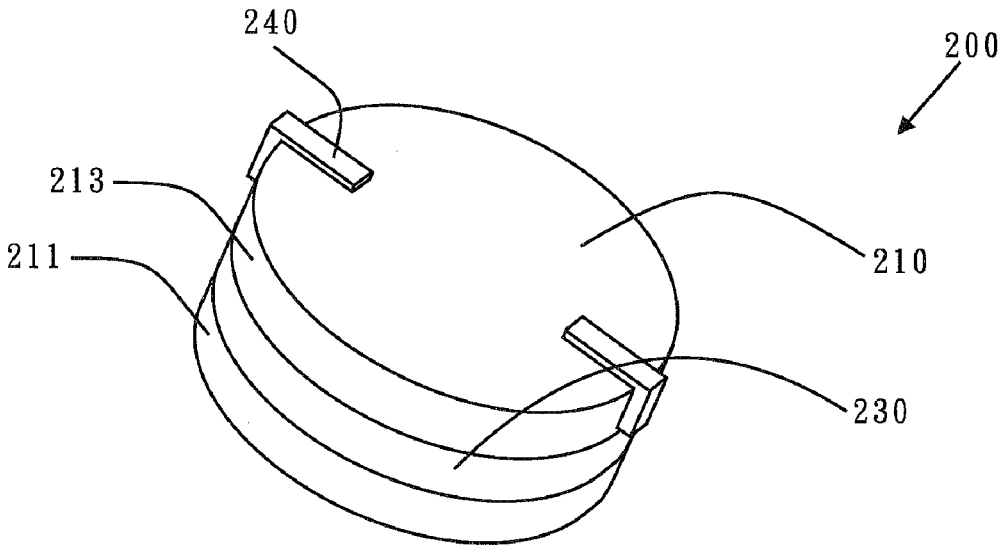
FIG. 2A shows a perspective view of a choke coil in accordance with a preferred embodiment of the present invention.
Figure 2B:
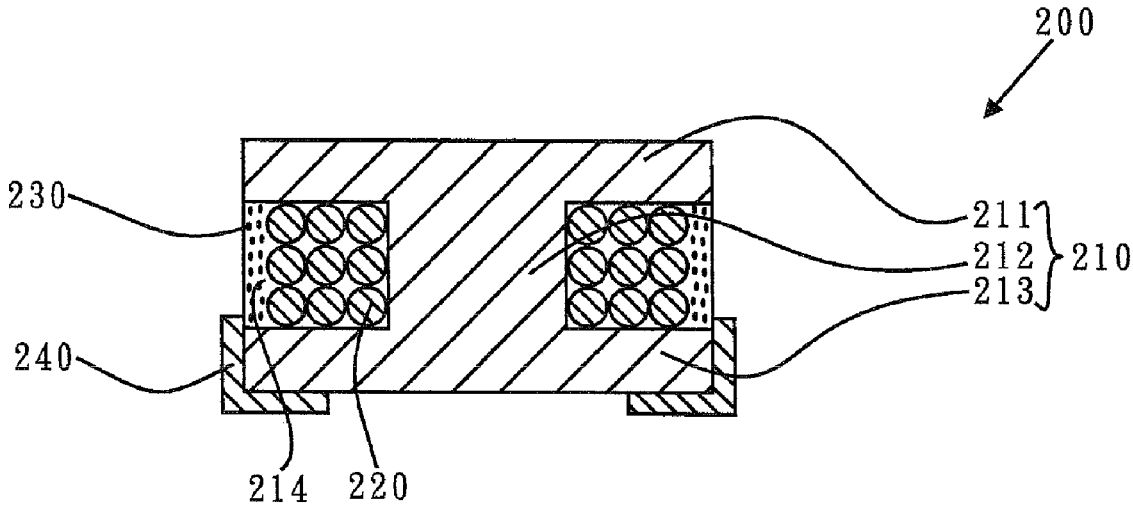
FIG. 2B shows a sectional view of the choke coil shown in FIG. 2A.

Referring to FIG. 2A and FIG. 2B, a choke coil 200 in accordance with a preferred embodiment of the present invention includes a magnetic core 210, a coil 220, magnetic material 230, and two electrode portions 240. The magnetic core 210 has a first permeability u1. The permeability is defined as the ratio of the magnetic flux (B) and the magnetic field (H) in the magnetic curve when the magnetic field (H)

approaches to zero. The unit of permeability is in the c.g.s. system. The magnetic core 210 includes an upper core 211, a lower core 213, and a middle core 212 located between the upper core 211 and lower core 213 so as to form a drum core. The upper core 211, the middle core 212, and the lower core 213 have cylindrical shapes. There is a wiring space 214 defined by the upper core 211, the middle core 212, and the lower core 213. The coil 220 is wrapped around the middle core 212 of the magnetic core 210 and is disposed within the wiring space 214.

The magnetic material 230 surrounds the coil 220 and is disposed within the wiring space 214 so as to make the shape of the choke coil 200 substantially a circular column (i.e., a cylinder). In the embodiment, the magnetic material 230 surrounds the coil 220 but not the upper core 211 and lower core 213 so as to enable the shape of the choke coil 200 to be substantially a cylindrical shape. The magnetic material 230 contacts the coil 220 substantially completely with little or no air space between the magnetic material 230 and the coil 220. According to this embodiment, the magnetic material 230 is applied around the coil 220 by an injection molding process, but the invention is not limited to this technique. For example, the invention can also use a coating process in which it is not necessary to apply a high forming pressure.

The magnetic material 230 has a second permeability u2. The first permeability u1 is higher than the second permeability u2. For example, in one embodiment, the first permeability u1 is from about 350 to about 1200, while the second permeability u2 is from about 5 to about 30. The magnetic material 230 includes mixture of a resin material and a magnetic powder material. The resin material and the magnetic powder material are mixed uniformly so as to be used as the injection material of the injection molding process. The magnetic material 230 is formed by injection molding the mixture around the coil 220.

Figure 4:
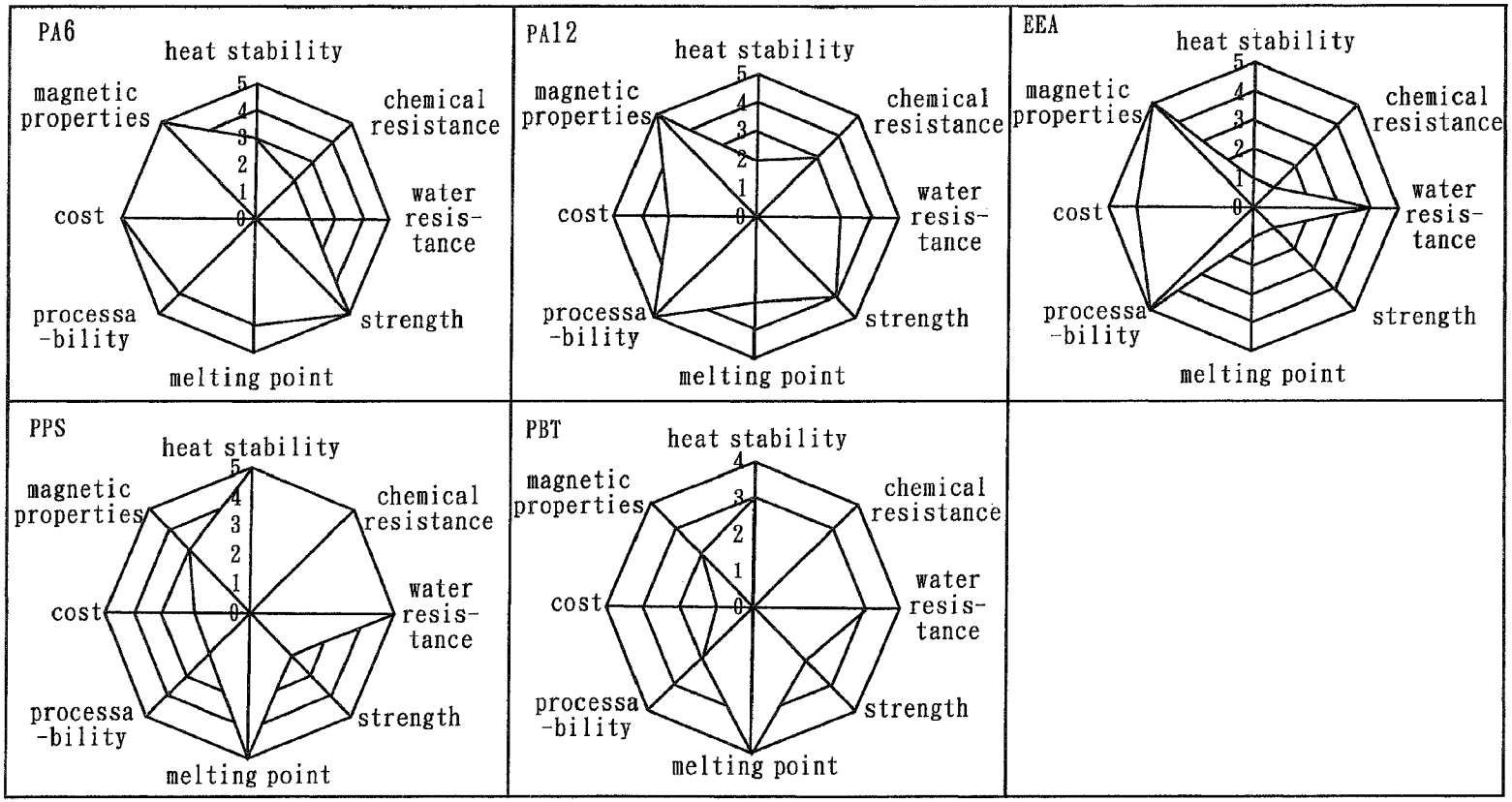
FIG. 4 shows the properties of different resin materials.

The resin material may be Polyamide 6 (PA6), Polyamide 12 (PA12), Polyphenylene Sulfide (PPS), Polybutylene terephthalate (PBT), ethylene-ethyl acrylate copolymer (EEA), or some other suitable resin material. The properties of the resin materials mentioned above are shown in FIG. 4. According to the embodiment of FIGS. 2A-B, the resin material is PPS. Because PPS is more heat stable and more chemically resistant than the other listed resin materials, the properties of the PPS resin material do not change much in high-temperature environments and chemical environments. Therefore, using PPS in the choke coil 200 provides better reliability than choke coils made using other resin materials, and the choke coil 200 will not be damaged in a reflow process.

The magnetic powder material can be a metal soft magnetic material or a ferrite. The metal soft magnetic material may include iron, an FeAlSi alloy, an FeCrSi alloy, a stainless steel, and/or some other suitable material. In the embodiment of FIGS. 2A-B, the magnetic powder material is iron, which has a higher saturation level than the other listed magnetic materials.

The electrode portions 240 are electrically connected to the two ends of the coil 220. Each electrode portion 240 includes a lead frame, where one end of the lead frame is connected to one end of the coil 220, and the other end of the lead frame extends through the magnetic material 230 to an outer surface of the choke coil 200. In this embodiment, the electrode portions 240 extend to an outer surface of the lower core 213 (shown in FIG. 2A). The electrode portions 240 are also able to be formed by flattening two ends of the coil 220.

As a result of the injection molding process, the magnetic material 230 surrounds the coil 220, and the coil 220 contacts the magnetic material 230 substantially completely, such that there is little or no air space between the coil 220 and the magnetic material 230. Therefore, the problem of the air space decreasing the magnetic flux and the inductance of the conventional choke coil 100 is solved. In addition, there is no need to position the magnetic core 210 precisely, thereby simplifying the manufacturing process of the choke coil 200 compared to the conventional choke coil 100. During the process of filling the magnetic material 230, since the coil 220 is wrapped around the magnetic core 210, the coil 220 is substantially supported. Furthermore, the process of filling the magnetic material 230 is by an injection molding process without applying the high pressure of a pressure molding machine, thus reducing the problem that the coil can be shorted. The stability of the manufacturing process and the reliability of the choke coil are thereby improved.

Figure 2C:
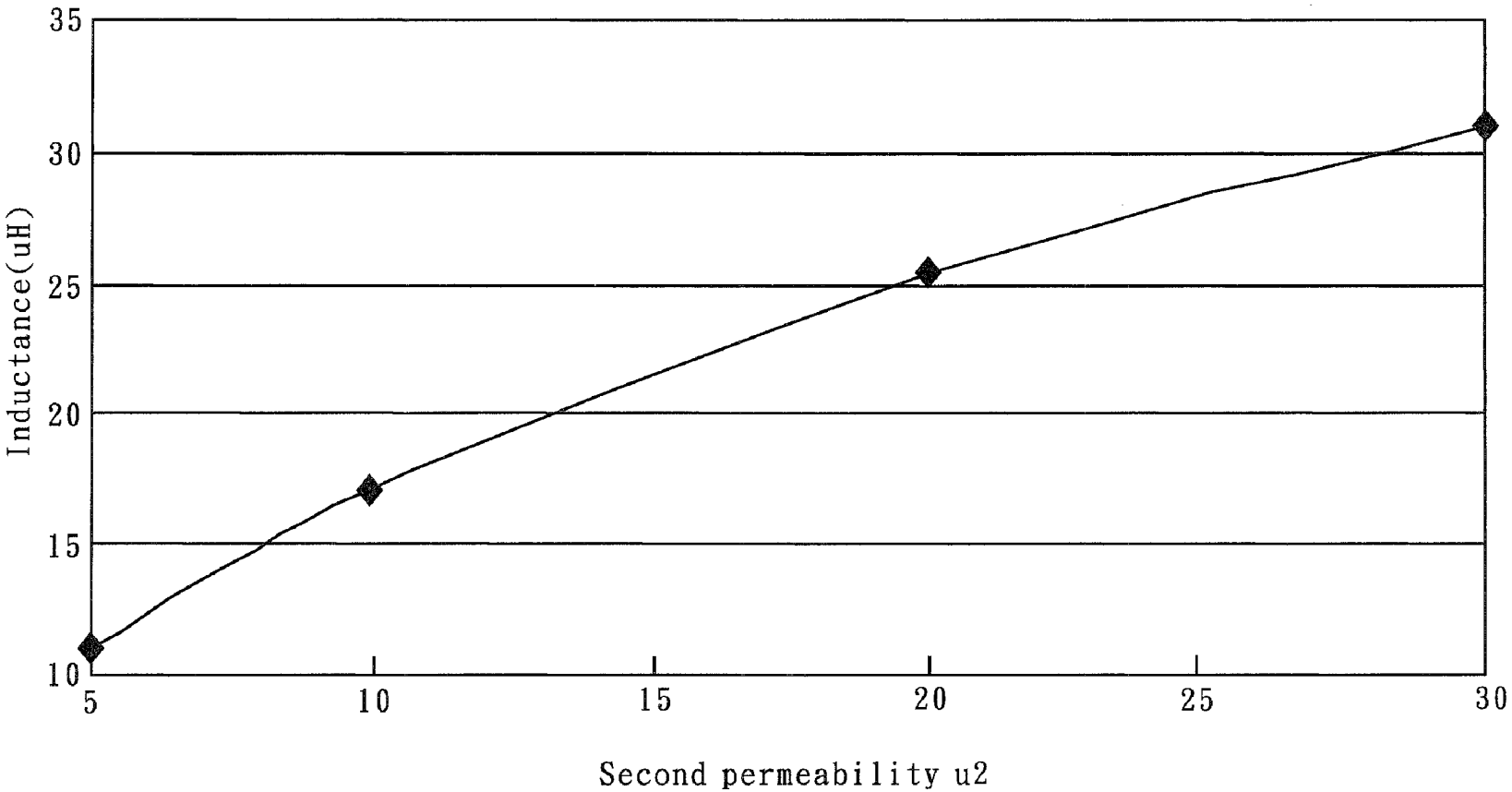
FIG. 2C shows the relationship between the inductance and the second permeability of the choke coil shown in FIG. 2A.

The choke coil 200 has a dimension of 3 mm×3 mm×1 mm, where the diameter of the middle core 211 is 1.1 mm. The upper core 211 and the lower core 213 have the same diameter, which is 3 mm. If the first permeability u1 is 450, and the second permeability u2 changes from 5 to 30, then the inductance of the choke coil 200 changes from 11 uH to 31 uH (shown in FIG. 2C). Therefore, the changing of the second permeability u2 enables the choke coil inductance to change. In addition to changing the number of turns of the coil 220 and the dimension of the magnetic core 210, the inductance of the choke coil 200 of the present invention can be changed by adjusting the second permeability u2. As such, the number of parameters available for adjusting the inductance of the choke coil 200 is increased compared to the conventional choke coil 100.

Referring to Table 1, by adjusting the second permeability u2 and the number of turns of the coil 220, a target inductance (e.g., 4.7 uH) can be achieved. Increasing the second permeability u2 enables the number of turns of the coil 220 to be decreased without affecting the target inductance so as to decrease the direct current resistance (DCR).

TABLE 1

| Second permeability u2 | First permeability u1 | Turns of the coil |
|---|---|---|
| 5 | 350~1200 | 13.5 |
| 10 | 350~1200 | 10.5 |
| 15 | 350~1200 | 9.5 |
| 20 | 350~1200 | 8.5 |
| 25 | 350~1200 | 7.5 |
| 30 | 350~1200 | 7.5 |

Figure 3A:
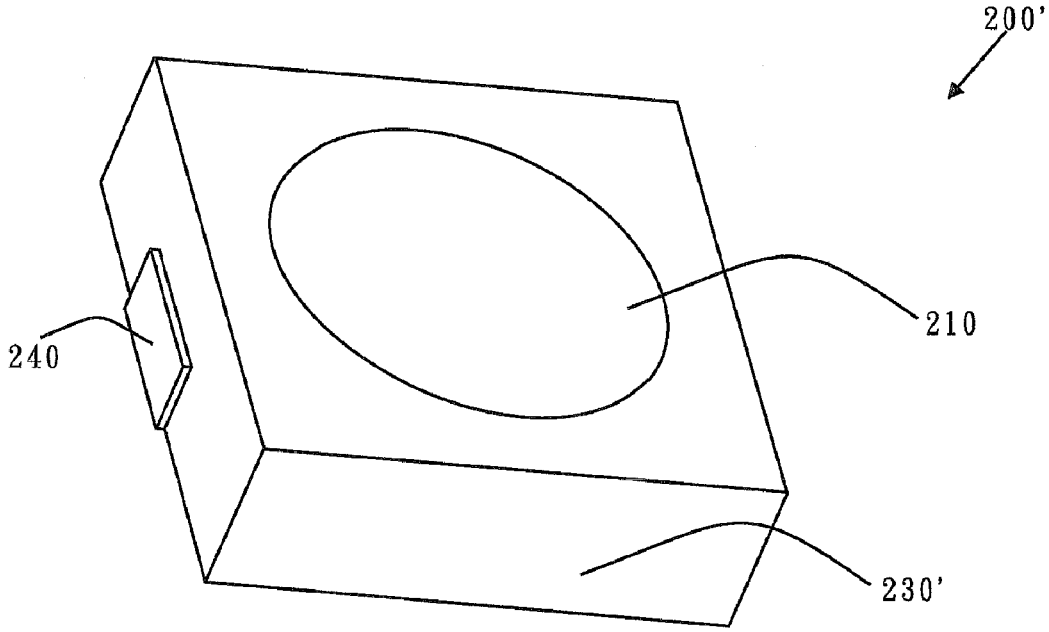
FIG. 3A shows a perspective view of a choke coil in accordance with another preferred embodiment of the present invention.
Figure 3B:
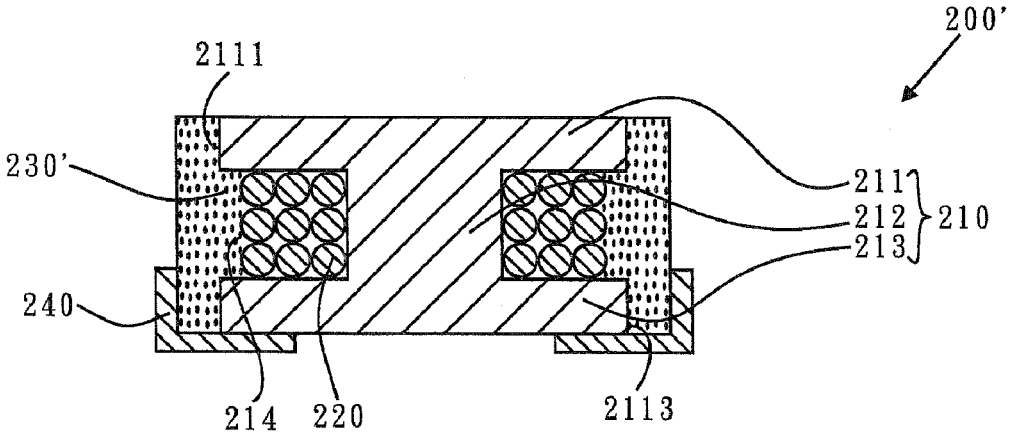
FIG. 3B shows a sectional view of the choke coil shown in FIG. 3A.
Figure 3C:
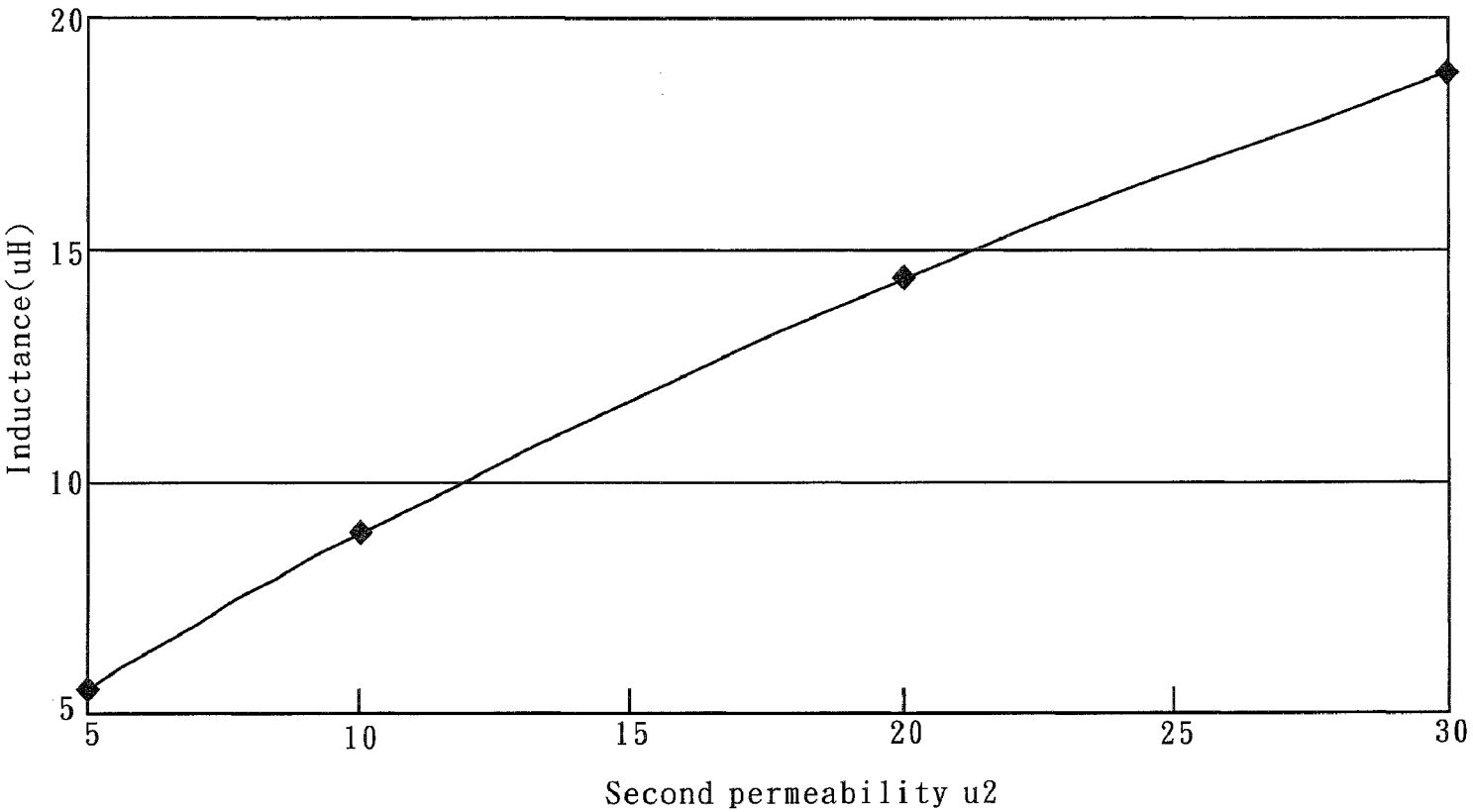
FIG. 3C shows the relationship between the inductance and the second permeability of the choke coil shown in FIG. 3A.

A choke coil 200' in accordance with another preferred embodiment of the present invention is shown in FIG. 3A and FIG. 3B. The difference between the choke coil 200' and the choke coil 200 is that, in addition to surrounding the coil 220, the magnetic material 230' also surrounds (i) the side surface 2111 of the upper core 211 and (ii) the side surface 2113 of the lower core 213 so as to enable the shape of the choke coil 200' to be substantially a rectangular parallelepiped. The choke coil 200' has a dimension of 3 mm×3 mm×1 mm, where the diameter of the middle core 211 is 1.1 mm. The upper core 211 and the lower core 213 have the same diameter, which is 2.2 mm. If the first permeability u1 is 450, and the second permeability u2 changes from 5 to 30, then the inductance of the choke coil 200' changes from 6 uH to 18 uH (shown in FIG. 3C). Similarly, the changing of the second permeability u2 enables the inductance to change. As with choke coil 200, the number of parameters for adjusting the inductance of choke coil 200' is increased compared to the conventional choke coil 100. The choke coil 200' shown in FIG. 3A has a dimension of 3 mm×3 mm×1 mm and an inductance of 4.7 uH.

Figure 5:
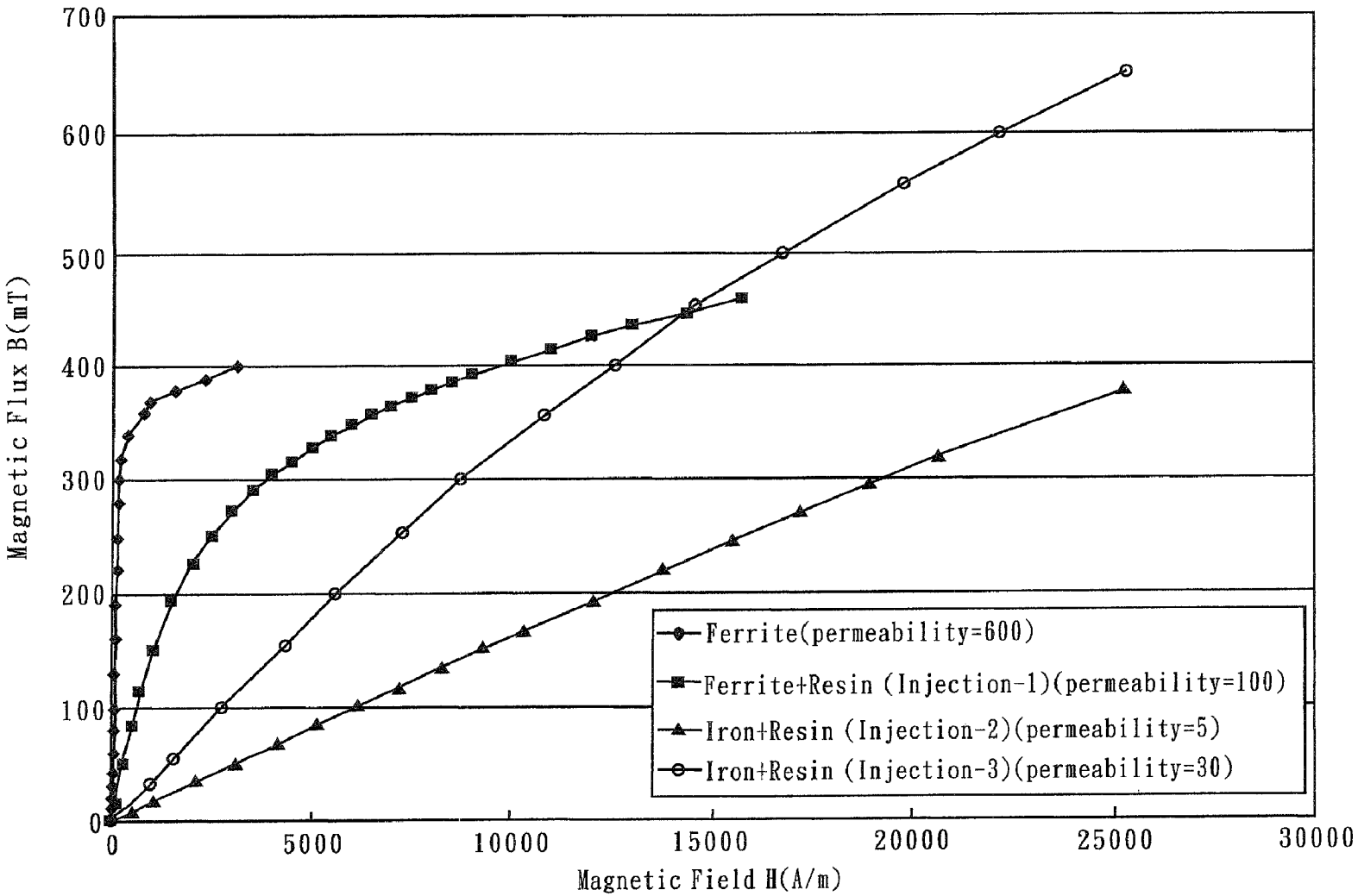
FIG. 5 shows the relationship between the magnetic field strength and the magnetic flux for four different implementations of the choke coil shown in FIG. 3A.

FIG. 5 shows the relationship between magnetic field strength H and magnetic flux B for four different implementations of choke coil 200' of FIG. 3A: one implementation in which the magnetic material 230' has a second permeability u2 of about 5 and comprises the resin material and the iron, a second implementation in which the magnetic material 230' has a second permeability u2 of about 30 and comprises the resin material and the iron, a third implementation in which the magnetic material has a second permeability u2 of about 100 and comprises the resin material and the Ferrite, and a fourth implementation in which the magnetic material has a second permeability u2 of about 600 and comprises the Ferrite. With a relatively low second permeability u2 of about 5 or about 30, choke coil 200' has relatively high saturation properties. With a higher second permeability u2 of about 100 or about 600, the choke coil has lower saturation properties.

Figure 6:
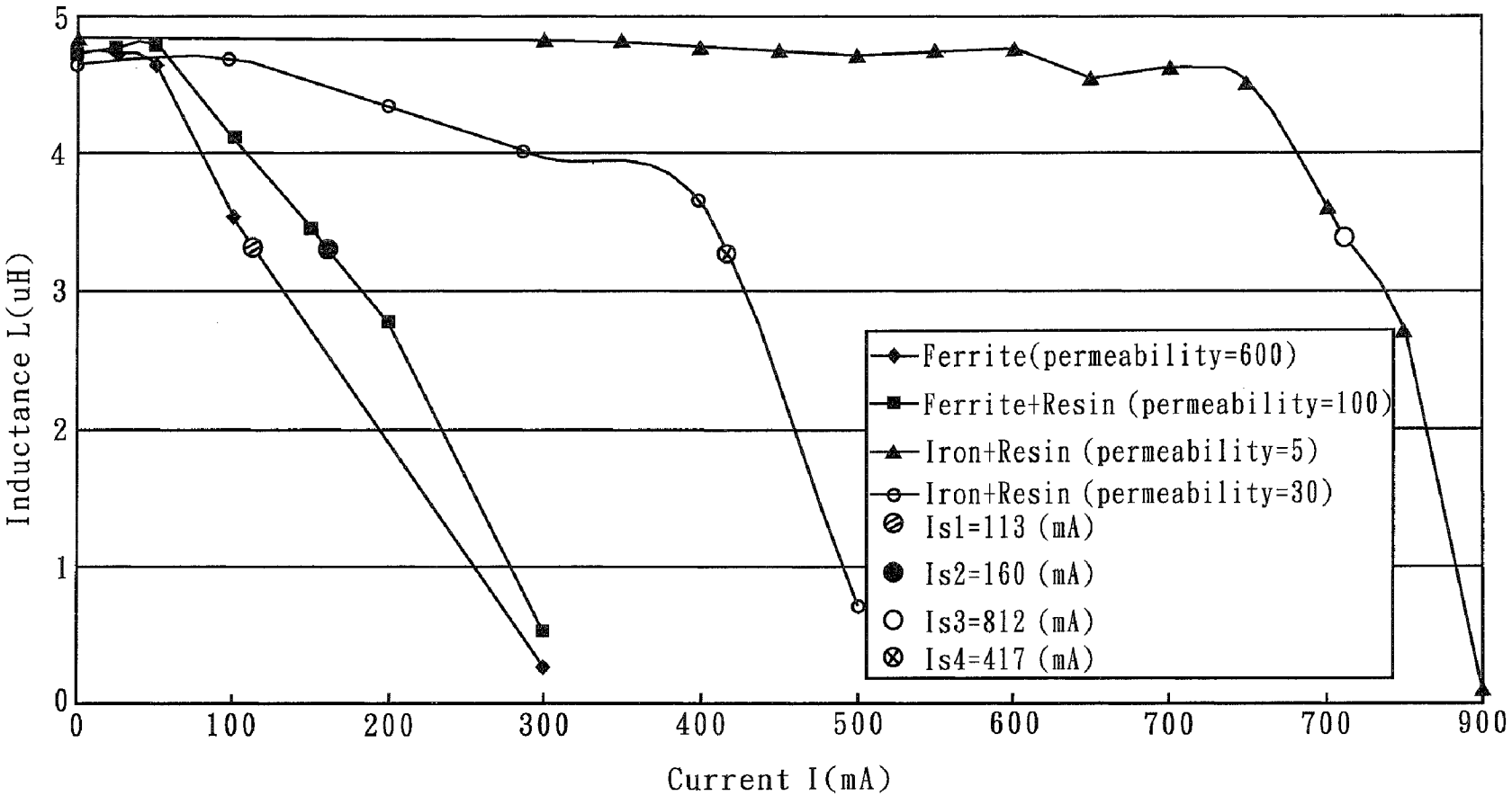
FIG. 6 shows the relationship between the inductance and the current for the four different implementations of FIG. 5.

Referring to FIG. 6, with a low second permeability u2 of about 5, the applicable current (saturation current) $I_S$ is about 812 mA. The saturation current $I_S$ is defined as the current when the inductance is decreased to 70% of the inductance when the current is near 0 mA. With a higher second permeability u2 of about 30, the applicable current $I_S$ is about 417 mA. With a still higher second permeability u2 of about 100, the applicable current $I_S$ is about 160 mA. With a yet higher second permeability u2 of about 600, the applicable current $I_S$ is about 113 mA.

Therefore, when the second permeability u2 of the magnetic material 230' is from about 5 to about 30, the choke coil 200' has better saturation properties and a higher applicable current than when the second permeability u2 of the magnetic material 230' is from about 100 to about 600.

Figure 1A:
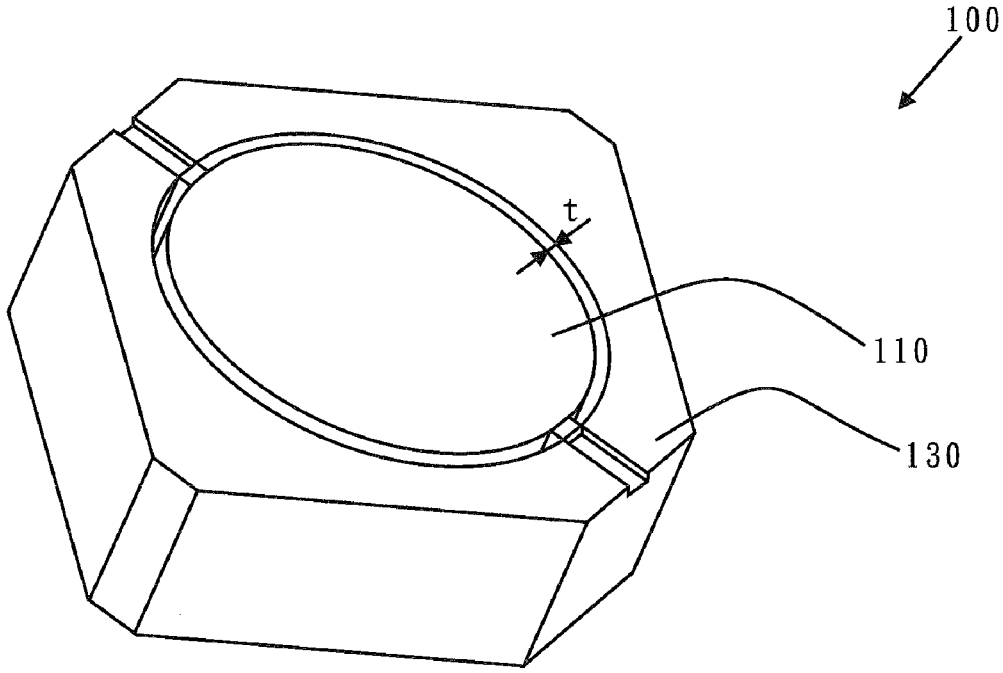
FIG. 1A(Prior Art)
FIG. 1A shows a perspective view of a conventional choke coil.
Figure 1B:
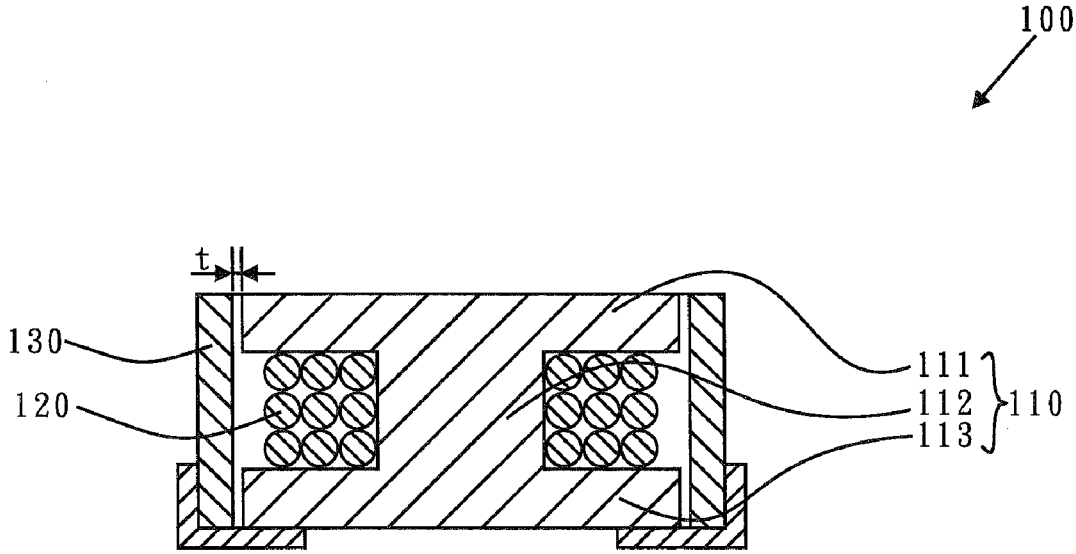
FIG. 1B(Prior Art)
FIG. 1B shows a sectional view of the choke coil shown in FIG. 1A.
Figure 1C:
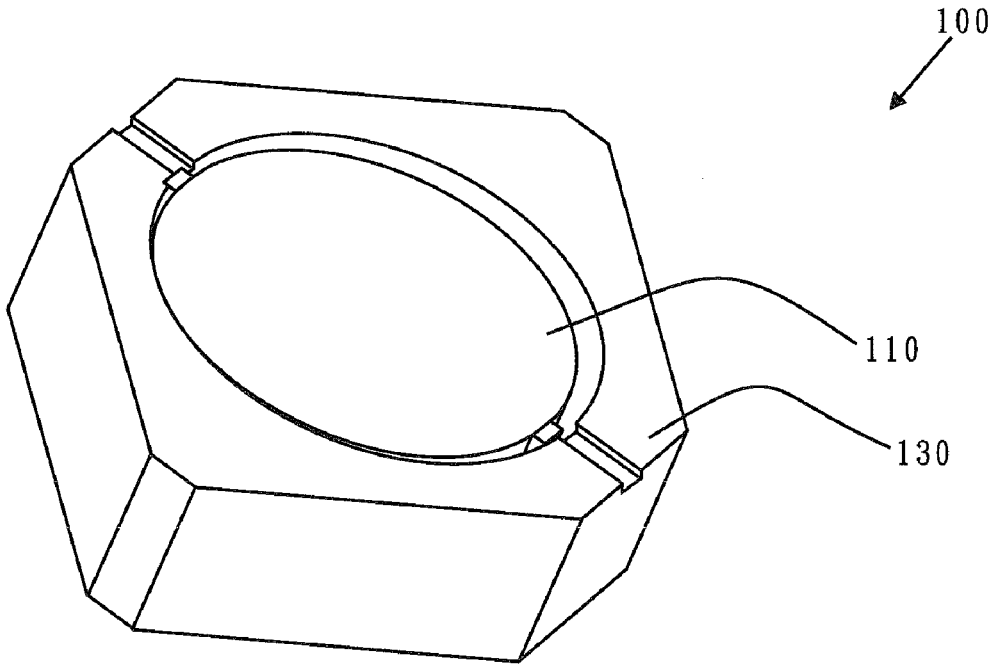
FIG. 1C(Prior Art)
FIG. 1C shows a perspective view of the choke coil shown in FIG. 1A, in which the core of the choke coil is shifted.

The conventional choke coil 100 shown in FIG. 1A and the choke coil 200' of the present invention shown in FIG. 3A have been simulated by computer software to check the distribution of magnetic flux. With the same dimensions and the same number of turns of coil, the inductance of the conventional choke coil 100 is L, while the inductance of the choke coil 200' of the present invention is about 1.36L. The structure of the present invention having no air space is able to increase the inductance by about 36%.

Figure 7:
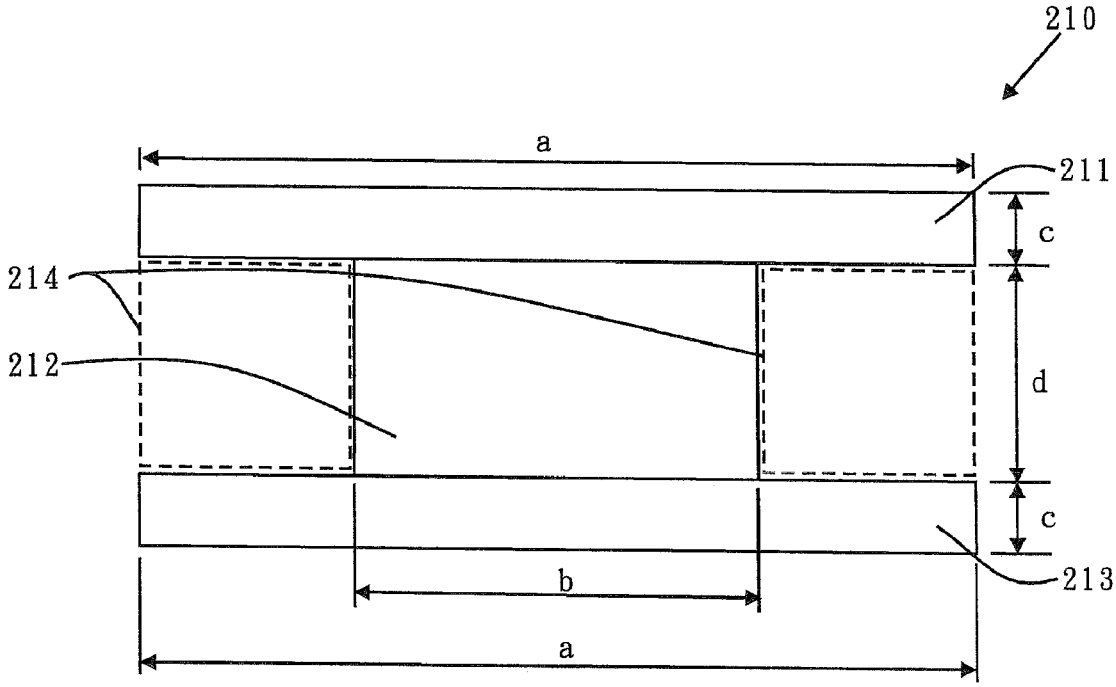
FIG. 7 shows the sectional view of the magnetic core shown in FIG. 3A.

Referring to FIG. 7, the upper core 211 of the magnetic core 210 has a first width a and a first thickness c. The lower core 213 has the same dimensions as the upper core 211. The middle core 212 has a second width b and a second thickness d. The choke coil 200' with different dimensions and inductances is used to perform a simulation so as to optimize both (i) the ratio of the second width and first width (b/a) and (ii) the ratio of the first thickness and the second thickness (c/d). Thus, the properties of the choke coil 200' are within the specification of the choke coil in the market.

In this simulation, the magnetic core 210 is made from a ferrite soft magnetic material having a first permeability u1 of about 350 to about 1200. The magnetic material 230' is a uniform mixture that (i) comprises a resin material and iron powder and (ii) has a second permeability u2 of about 5 to about 30. The detailed dimensions and inductance for the simulation are shown in Table 2, while the results of the simulation are shown in Table 3.

TABLE 2

| Condition | Dimension (mm) Length × Width | Dimension (mm) Thickness | Inductance (uH) | First permeability u1 | Second permeability u2 |
|---|---|---|---|---|---|
| A | 1 × 1 | 0.6, 3, 5 | 1.0, 10, 47 | 350-1200 | 5, 30 |
| B | 5 × 5 | 0.6, 3, 5 | 1.0, 10, 47 | 350-1200 | 5, 30 |
| C | 10 × 10 | 0.6, 3, 5 | 1.0, 10, 47 | 350-1200 | 5, 30 |

TABLE 3

| Condition | Dimension(mm) L × W × T(mm) | Inductance (uH) | b/a | c/d |
|---|---|---|---|---|
| A | 1 × 1 × 0.6 | 1.0~47 | 0.375~0.688 | 0.263~1.11 |
| | 1 × 1 × 3.0 | 1.0~47 | 0.375~0.688 | 0.278~0667 |
| | 1 × 1 × 5.0 | 1.0~47 | 0.375~0.688 | 0.3~0.7 |
| B | 5 × 5 × 0.6 | 1.0~47 | 0.372~0.698 | 0.263~1.11 |
| | 5 × 5 × 3.0 | 1.0~47 | 0.372~0.698 | 0.278~0.667 |
| | 5 × 5 × 5.0 | 1.0~47 | 0.372~0.698 | 0.3~0.7 |
| C | 10 × 10 × 0.6 | 1.0~47 | 0.367~0.667 | 0.263~1.11 |
| | 10 × 10 × 3.0 | 1.0~47 | 0.367~0.667 | 0.278~0.667 |
| | 10 × 10 × 5.0 | 1.0~47 | 0.367~0.667 | 0.3~0.7 |

Referring to Table 3, in the condition A, the ratio of the second width and first width (b/a) is from about 0.375 to about 0.688, while the ratio of the first thickness and the second thickness (c/d) is from about 0.3 to about 0.667. In the condition B, the ratio of the second width and first width (b/a) is from about 0.372 to about 0.698, while the ratio of the first thickness and the second thickness (c/ d) is from about 0.3 to about 0.667. In the condition C, the ratio of the second width and first width (b/a) is from about 0.367 to about 0.667, while the ratio of the first thickness and the second thickness (c/d) is from about 0.3 to about 0.667. For all three conditions A, B, and C to occur simultaneously, the ratio of the second width and first width (b/a) should be from about 0.375 to about 0.688, while the ratio of the first thickness and the second thickness (c/d) should be from about 0.3 to about 0.667.

In the application of the choke coil, the direct current resistance (DCR) and the saturation current $I_S$ are typically necessary to be considered. According to the energy equation $I^2R$ and Faraday's Law, for a given dimension of the choke coil, if the direct current resistance is lower, then the saturation properties are worse.

Figure 8:
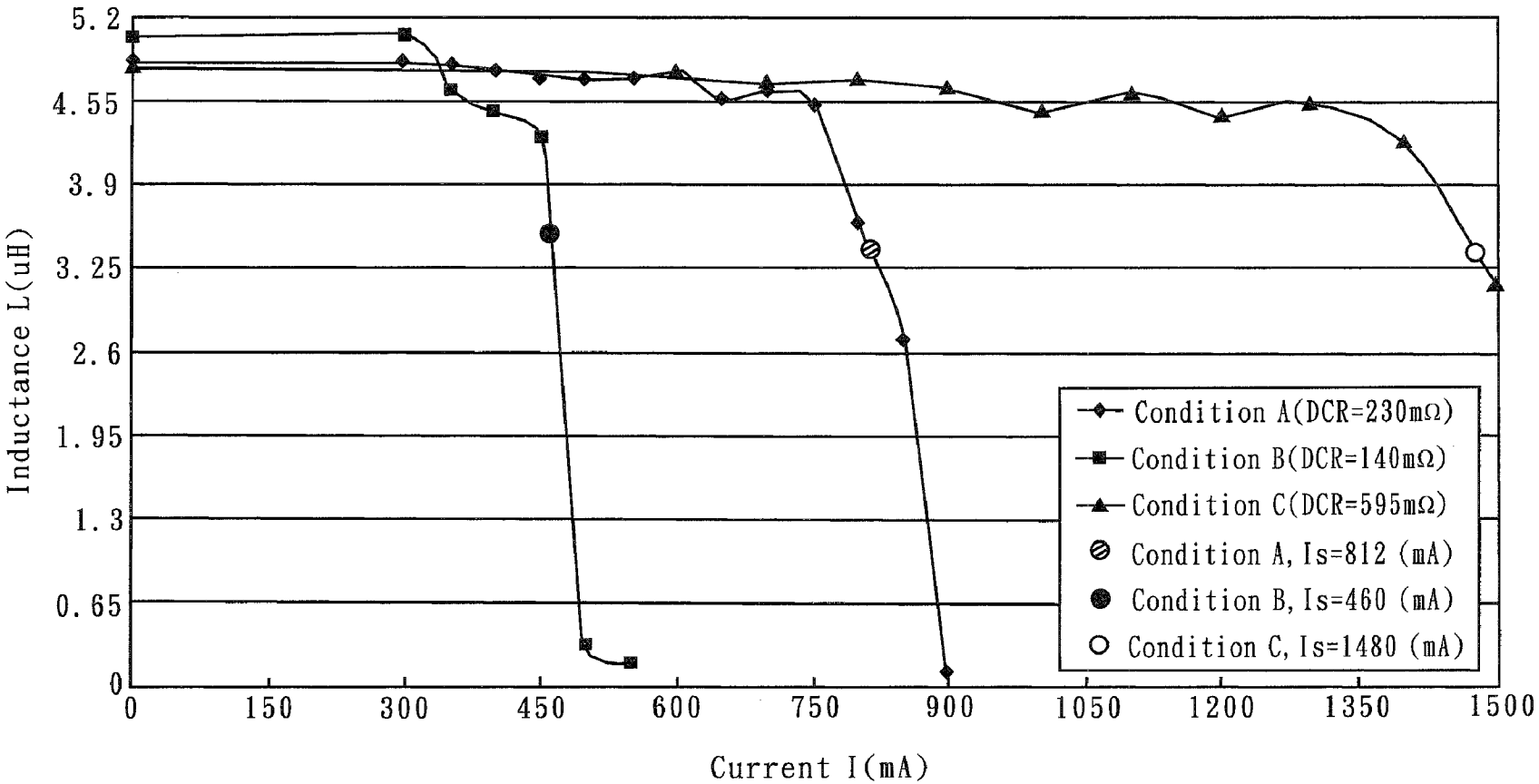
FIG. 8 shows the relationship between the inductance and the current for three different implementations of the choke coil shown in FIG. 3A.

For an exemplary application of low direct current resistance (DCR≦140 mΩ) and high saturation current ($I_S$≧1480 mA), the optimal ratio of the second width and first width (b/a) and the optimal ratio of the first thickness and the second thickness (c/d) were achieved by simulation. The simulation used the choke coil 200' shown in FIG. 3A, where the choke coil 200' has a dimension of 3 mm×3 mm×1 mm and an inductance of 4.7 uH. The simulation results are shown in FIG. 8 and Table 4. The condition A is a baseline. The condition B is for an application of low direct current resistance, where the direct current resistance of the condition B is 60% of the direct current resistance of the condition A. The condition C is for an application of high saturation current, where the saturation current of the condition C is 180% of the saturation current of the condition A.

TABLE 4

| Condition | b/a | c/d | Direct current resistance (DCR) | Saturation current ($I_s$) |
|---|---|---|---|---|
| A | 0.593 | 0.526 | 230 mΩ | 812 mA |
| B | 0.3696 | 0.3125 | 140 mΩ | 460 mA |
| C | 0.696 | 0.647 | 595 mΩ | 1480 mA |

Referring to Table 4, in the application of the low direct current resistance, the ratio of the second width and first width (b/a) is about 0.3696, and the ratio of the first thickness and the second thickness (c/d) is about 0.3125. In the application of the high direct current resistance, the ratio of the second width and first width (b/a) is about 0.696, and the ratio of the first thickness and the second thickness (c/d) is about 0.647.

Although specific embodiments have been illustrated and described, it will be appreciated by those skilled in the art that various modifications may be made without departing from the scope of the present invention, which is intended to be limited solely by the appended claims.

What is claimed is:

1. An optimized choke coil, comprising:

a magnetic core having a first permeability which is from about 350 to about 1200, wherein:

the magnetic core is a drum core comprising an upper core, a middle core, and a lower core;

the upper core and the lower core have a same first width and a same first thickness;

the middle core has a second width, wherein a ratio of the second width to the first width is from about 0.367 to about 0.667; and the middle core has a second thickness, wherein a ratio of the first thickness to the second thickness is from about 0.3 to about 0.667;

a coil wrapped around said magnetic core;

a magnetic material surrounding said coil and having a second permeability which is from about 5 to about 30; and an electrode portion connected to one end of said coil, wherein the choke coil has a saturation current greater than 160 mA.

2. The choke coil according to claim 1, wherein said magnetic material is surrounded said coil by an injection molding process.

3. The choke coil according to claim 1, wherein there is no air space between said coil and said magnetic material.

4. The choke coil according to claim 1, wherein said magnetic material comprises a resin material and a magnetic powder material.

5. The choke coil according to claim 4, wherein said resin material is selected from Polyamide 6, Polyamide 12, Polyphenylene Sulfide, Polybutylene terephthalate, and ethylene-ethyl acrylate copolymer.

6. The choke coil according to claim 4, wherein said resin material is Polyphenylene Sulfide.

7. The choke coil according to claim 4, wherein said magnetic powder material comprises a metal soft magnetic material or a ferrite.

8. The choke coil according to claim 7, wherein said metal soft magnetic material comprises at least one of iron, an FeAlSi alloy, an FeCrSi alloy, and a stainless steel.

9. The choke coil according to claim 1, wherein said magnetic core is made from a ferrite soft magnetic material.

10. The choke coil according to claim 1, wherein said upper core, said middle core, and said lower core define a wiring space, said coil and said magnetic material are disposed within said wiring space.

11. An optimized choke coil, comprising:

a magnetic core having a first permeability and comprising an upper core, a lower core, and a middle core located between the upper and lower cores, wherein:

the first permeability is from about 350 to about 1200;

the upper and lower cores have a similar shape of a first width and a first thickness;

the middle core has a cylindrical shape of (i) a second width, smaller than the first width, and (ii) a second thickness, larger than the first thickness;

a ratio of the second width to the first width is from about 0.367 to about 0.667;

a ratio of the first thickness to the second thickness is from about 0.3 to about 0.667; and the upper, middle, and lower cores define a wiring space;

a coil wrapped around the middle core within the wiring space;

a magnetic material surrounding the coil and having a second permeability less than the first permeability, wherein the second permeability is from about 5 to about 30; and an electrode portion connected to one end of the coil and extending through the magnetic material, wherein the choke coil has a saturation current greater than 160 mA.

12. The choke coil according to claim 11, wherein the magnetic material surrounds the coil and side surfaces of the upper and lower cores.

13. The choke coil according to claim 12, wherein the choke coil has a rectangular parallelepiped shape.

14. The choke coil according to claim 11, wherein the magnetic material surrounds the coil but not the upper and lower cores.

15. The choke coil according to claim 14, wherein the choke coil has a cylindrical shape.

16. The choke coil according to claim 11, wherein there is substantially no air space between the magnetic material and the coil.

17. The choke coil according to claim 11, wherein the magnetic material comprises a mixture of a resin material and a magnetic powder material.

18. The choke coil according to claim 17, wherein:

the resin material is one of Polyamide 6, Polyamide 12, Polyphenylene Sulfide, Polybutylene terephthalate, and ethylene-ethyl acrylate copolymer;

the magnetic power material is one of a metal soft magnetic material and a ferrite;

the metal soft magnetic material comprises at least one of iron, an FeAlSi alloy, an FeCrSi alloy, and a stainless steel; and the magnetic core is made from a ferrite soft magnetic material.

19. The choke coil according to claim 17, wherein the magnetic material is formed by injection molding the mixture around the coil.

20. The choke coil according to claim 17, wherein the magnetic material is formed by applying the mixture around the coil using a coating process.

21. The choke coil according to claim 11, there is substantially no air space between the magnetic material and the coil;

the upper and lower cores have a similar cylindrical shape of the first width and the first thickness;

the magnetic material comprises a mixture of a resin material and a magnetic powder material;

the resin material is one of Polyamide 6, Polyamide 12, Polyphenylene Sulfide, Polybutylene terephthalate, and ethylene-ethyl acrylate copolymer;

the magnetic power material is one of a metal soft magnetic material and a ferrite;

the metal soft magnetic material comprises at least one of iron, an FeAlSi alloy, an FeCrSi alloy, and a stainless steel;

the magnetic core is made from a ferrite soft magnetic material; and the magnetic material is formed by injection molding the mixture around the coil.

22. The choke coil according to claim 21, wherein:

the magnetic material surrounds the coil and side surfaces of the upper and lower cores; and the choke coil has a rectangular parallelepiped shape.

23. The choke coil according to claim 21, wherein: the magnetic material surrounds the coil but not the upper and lower cores; and the choke coil has a cylindrical shape.

* * * * *